United States Patent [19]

Perrella et al.

[11] Patent Number: 4,832,110

[45] Date of Patent: May 23, 1989

[54] MINIATURE DIE-CASTING MACHINE

[76] Inventors: Guido Perrella, No. 9 Ch. Belvedere, Westmount, P.Q., Canada, H3Y 1P3; William E. Thompson, R.R. 1, Box 89, Middletown, Ind. 47356

[21] Appl. No.: 205,679

[22] Filed: Jun. 13, 1988

[51] Int. Cl.[4] ..... B22D 33/04; B22D 17/24

[52] U.S. Cl. ..... 164/316; 164/340; 164/342

[58] Field of Search ..... 164/340, 342, 137, 316

[56] References Cited

U.S. PATENT DOCUMENTS

| | | | |
|---|---|---|---|
| 2,445,995 | 7/1948 | Bourret et al. | 164/340 X |
| 3,165,796 | 1/1965 | McDonald | 164/340 X |
| 3,468,367 | 9/1969 | Bauer | 164/340 |
| 3,495,650 | 2/1970 | Perrella | 164/340 X |
| 4,210,196 | 7/1980 | Weiner | 164/340 X |
| 4,248,289 | 2/1981 | Perrella et al. | 164/340 X |

*Primary Examiner*—Nicholas P. Godici
*Assistant Examiner*—J. Reed Batten, Jr.
*Attorney, Agent, or Firm*—Woodard, Emhardt, Naughton, Moriarty & McNett

[57] ABSTRACT

A die-casting machine for the production of miniature die-cast parts of the type having a parting line and a plurality of cores includes a frame member having a plurality of tie bars and a first movable platen on one side of a parting line and a second movable platen on the opposite side of the parting line. The movable platens are slidably received by the tie bars and a pair of lever arms are provided wherein a first lever arm supports the first movable platen and a second lever arm supports the second movable platen. The die block is arranged into two halves about its own parting line such that one half is mounted to the first movable platen and the other half is mounted to the second movable platen. The particular arrangement of lever arms enables the die block to be positioned relative to the remainder of machine such that an arrangement of six retractable cores can be utilized as part of the die-cast part wherein there are three coaxial pairs configured for movement along conventional X, Y and Z axes. The positioning of the die block relative to the remainder of the machine is such that the total of six cores can be machine introduced without interference.

17 Claims, 18 Drawing Sheets

MINIATURE DIE-CASTING MACHINE

BACKGROUND OF THE INVENTION

This invention relates in general to die-casting machines and in particular to high-speed die-casting machines for the production of precision miniature castings where the weight of the produced casting generally does not exceed two ounces and the face of the die generally does not exceed approximately ten square inches. While these size limitations provide a suitable focus, many of the features of the present invention are applicable to much larger machines.

Heretofore, machines for the die casting of precision miniature pieces have been generally of the Dynacast type, a die-casting machine developed in the mid-1960's and the subject of several United States patents, including U.S. Pat. No. 3,364,981. This machine, at the time of its development, drastically changed the manufacture of miniature die-casting pieces which prior to the time of the U.S. Pat. No. 3,364,981 were manufactured in large conventional die-casting machines using multiple-cavity dies. However, the state of the art has remained practically unchanged during the last 20 years. At the expiration of the above-mentioned patent, the machine has been duplicated by several manufacturers with more or less the same features but without eliminating the various shortcomings.

One shortcoming of the Dynacast machine is the fact that the machine can use only two vertical cores and only occasionally a frontal core. The zinc injection system of the Dynacast machine is made by a gooseneck partially submerged into the liquid zinc of the melting pot. The gooseneck has a swiveling movement in order to bring the nozzle in contact with the die face and to move the nozzle away from the die face to break the runner from the liquid metal. Besides the mechanical elements needed for this movement (which adds complexity to the machine), this system reduces the speed at which the machine can operate. The position of the gooseneck precludes the use of a fourth core.

Another shortcoming of the Dynacast machine includes the way the level of the zinc in the neck of the gooseneck is controlled. This system leaves a certain amount of air ahead of the zinc in the neck of the gooseneck, which amount of air is variable and depends upon several parameters which are not easily controlled, such as the temperature of dies, size of the shots, speed of the machine and temperature of the nozzle. Another drawback of the Dynacast machine is the way the toggle mechanism operates in order to close the die halves and to create the force between them. This force generated between the dies varies, depending on the wear of the mechanical components of the toggles, temperature of the dies, temperature of the plate of the machine, and so forth.

A further drawback of the Dynacast machine is the fact that it cannot produce parts with what is known in the industry as a "hardware" finish; in other words, parts that do not need to be plated. The reason for such inability involves the way the zinc is injected into the die, the gating (which has to be small because of the subsequent separation from the part with the tumbling operation) and the system of heat transfer on the die. The parts from the Dynacast machine are ejected with the gates attached to them, and this requires a subsequent operation (tumbling) in order to separate the parts from the gate, with all of the negative attributes of such operation including surface pitting, dimensional alteration, and breaking of sharp corners.

The present invention provides a machine which is designed to overcome the above shortcomings and disadavantages. In order to achieve this object, the disclosed machine produces castings which may require up to four cores along the plane of the dies (substantially two vertical and two horizontal) and two cores in a plane perpendicular to the surface of the die with a total of six cores. The machine of the present invention produces castings with much less porosity than any other machine used today and with surface finish of the type as previously mentioned which is known in the industry as a hardware finish. The cast pieces can be trimmed automatically in the machine so that the pieces are separated from the gate, the gates being discharged in a separate container for a subsequent remelt.

Another reference of possible interest to the heat transfer aspects of the present invention is U.S. Pat. No. 4,248,289 which issued to Perella et al. This patent discloses a means to heat the heat-exchange medium, water, by electric immersion heaters to preheat the die aove the normal boiling point of water by controlling the internal pressure of the die-cooling cavity. Die cooling is accomplished by the heat of evaporation at the temperature and pressure required for best casting quality. The wall thickness of the die cavity to water cavity is sized according to the heat-transfer rate or the die-cavity material. As steam is produced within the cavity, make-up water is introduced to maintain a wetted surface.

In die-casting practice, the "coring" of a cast part encompasses many forms. The core may be in the form of an entry hole, round, square or otherwise, a hollow space, a countersunk or extended boss, an embossed face, or any shape that is required that is not formed by the two-part mold cavity. Some core requirements are parallel to the line of separation of the mold halves but are independent in movement. Other cores not in the line of mold separation movement must be positioned and supported either by devices integral with the die blocks or as a function of the die-casting machine. Those arrangements which are integral with the molding dies add substantially to the cost of the dies and are not practical for miniature casting work. Since the hydraulic pressure area of some cores can be equal to that of the die cavity, it is necessary to have equal support to that of the die cavity to lock the core in a fixed position. This may be accomplished by toggle movement to rapidly position the core in the die and then lock the position as securely as the main die-closing action.

SUMMARY OF THE INVENTION

A die-casting machine for the production of cast parts of the type having a parting line and wherein the cast part includes a plurality of cores according to one embodiment of the present invention includes a frame member including two substantially parallel tie bars disposed in a center plane of the machine, a first movable platen disposed on one side of the parting line and a second movable platen disposed on the other side of the parting line, the two movable platens being slidably received by the tie bars, a pair of lever arms wherein a first lever arm supports the first movable platen and a second lever arm supports the second movable platen, a die block arranged into two halves on opposite sides of the parting line, both halves being positioned remote from said center plane, one die half mounted to the first movable platen and the other die half mounted to the second movable platen, and arranged into six retractable cores wherein there are three coaxial pairs configured for movement along conventional X, Y, and Z axes and the positioning of the die block relative to the remainder of the die-casting machine being such that the total of six cores can be machine-introduced.

One object of the present invention is to provide an improved die-casting machine for the production of cast parts having a plurality of cores.

Related objects and advantages of the present invention will be apparent from the following description.

DESCRIPTION OF THE PREFERRED EMBODIMENT

Figure 1:
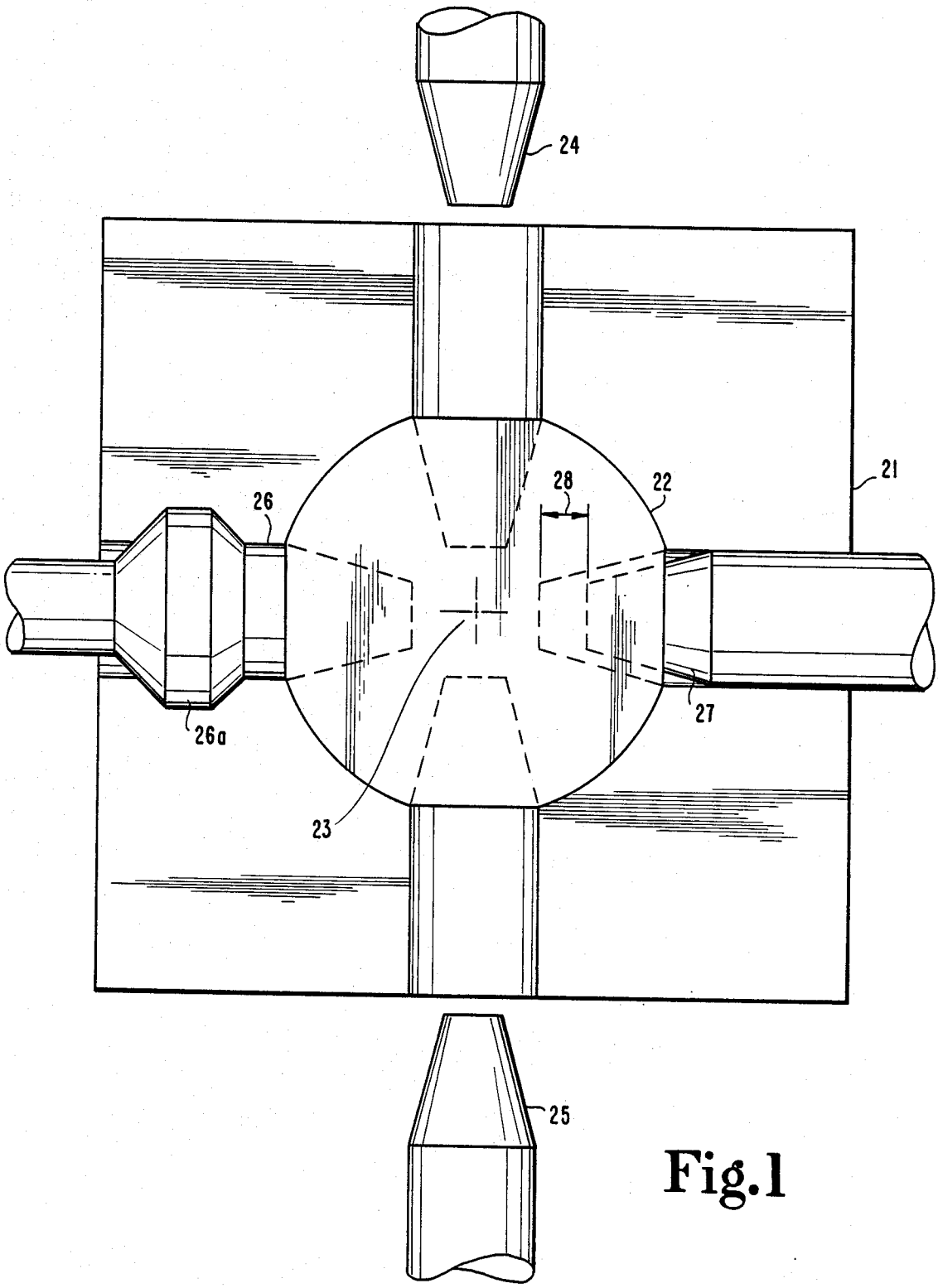
FIG. 1 is side elevation view of four core entries around the parting plane of a die comprising a portion of the present die-casting machine invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The machine of the present invention is conceived as a departure from the constraints set by previous die-casting practice for machines used for the production of miniature die castings. In order to overcome the shortcomings of the previously mentioned Dynacast type machine, it was necessary to completely change the concept of operation, changes that permit casting parts with up to six cores and that permit the automatic transfer the parts out of the die.

As a general overview of the present invention, there are four core-carrying mechanisms (machine-introduced) that surround the four sides of the die and which are on the parting plane of the die, one of which acts as a transfer to carry the part out and to an automatic stripper (trimmer). Two other cores (for a total of six) are on the axis of the two die halves and are actuated by cylinder movement. The two die halves each separate from the center parting line plane of the machine to maintain a mechanical and thermal balance to the casting operation. The machine platens to which the dies are keyed in place and attached are positioned off-center from the plane of the two tie bars and are carried by two lever frames on either side, a feature which enables free access (without interference with the machine) for core mechanism entry (machine-introduced), and subsequent exit of the part from the die. The lever frames comprise a Class-1 type of lever with the centerline of the die axis at one end and an adjustable reaction support at the other end, a feature which serves as a positive means to apply the die-lock forces as required to prevent flash at the parting line.

An important aspect of the machine is the die-closing and die-lock mechanism which utilizes a toggle linkage, only as a low-force closing device to bring the dies together rapidly and without impact, which then is followed up by the hydraulic cylinder force to provide a constant die lock load as a function of cylinder area times pressure, rather than the constantly-varying load normally associated with load generation by a toggle system.

The heat transfer within the dies features a system of design wherein the water side of the cooling chamber is excavated to follow the shape of the hot metal side of the part cavity as close as practical thus leaving a nearly constant wall thickness through which the heat is conducted from the hot metal side to the cooling side. The excavated water cavity is furnished with water under specific pressure to boil at the required die temperature for a quality die-casting finish. The area is then capped off with a back plate and O-ring seal around the periphery and around any intersecting holes.

The metal injection system consists of a hydraulic ram within a block to intensify the metal pressure as required to pressurize the fluid metal through the control valves, extension tubes, nozzle and into the cavity. When the ram retracts, the metal in the extension tubes is checked against back flow from the nozzle by an integral ball valve and new metal is drawn into the bottom of the injection block from the supply bath to a second integral valve. Then a second plunger, integral with the injection block, and between the last check valve and the nozzle extension, withdraws with an adjustable stroke to enable retraction of the fluid metal at the tip of the nozzle before the die opens to prevent drip.

The metal injection unit is connected to the nozzle by a tubular riser, extension and angular elbow which is held at the fluid metal temperature by a spiral form of resistance wire within ceramic insulating beads, each with a control power source and thermocouple. The nozzle which is clamped between the die blocks when the dies close is the form of a square-diagonal and tapered slightly to allow for adjustable fit in the die and has a limited amount of area contact to reduce transfer of heat to the die.

Since both die halves move from an open position to a common parting line plane, one side comes to a fixed abutment stop while the other is held slightly away by spring force during the closing action until the final locking force is applied. An important part of the operational features of the present invention is the timing and position of the core opposite to the carry-out core. It is only slightly retracted prior to the die opening, enough to be free of the cored hole, but remains within the casting so as to act as a positive stripper as both the die halves open, a feature which in most cases can eliminate the need for stripper pins. All core-positioning mechanisms have the load capability to sustain the same force as the die-locking members in the event that side cores are equal in pressure area to that of the main die cavity.

Having a general overview of the complete operation of the present invention, reference will now be made to the specific figures, the structures illustrated therein, and the specific components and their relationship to one another which comprise the present invention.

Referring to FIG. 1, there is illustrated molding die block 21 wherein in the preferred embodiment the face of the half die has a maximum surface area of 10 square inches. Excavated cavity 22 is shaped to suit the particular part to be cast and is symmetrical to and surrounds axis 23 which is both the axis of the molding die and the axis of the machine accessories that serve the molding die, into which there are four lines of entry for up to four cores wherein each core is substantially normal to the adjcaent cores (i.e., 90-degree spacing). Illustrated is the top core 24, the bottom core 25, which is substantially normal to the top core, the transfer core 26 substantially normal to the core 25, and the rear core 27 which is substantially normal to core 26. Core 27 is shown slightly retracted by the amount of distance 28. This slightly retracted core serves as an automatic part stripper to impale the part on the core 27 loosely as each of the die halves separate away from the parting plane. In operation, all cores required to form the part are positioned in place prior to die close and each die half closes around them. Then when the injected metal to make the part has solidified, cores 24 and 25 are retracted fully, core 27 is retracted the amount of distance 28 and then each die half opens leaving the cast part on core 26 which is one of several spokes on an indexing wheel (see FIG. 2) used to transfer the part out of the die space to a discharge position. Core 26 has an enlarged portion **26*a* which serves to retain core 26 at its desired location within the die against the metal injection pressure. Cores 24, 25 and 27** are held in position against injection pressure by toggle mechanisms driven by the parent machine. These toggle mechanisms will be described in greater detail hereinafter.

Figure 2:
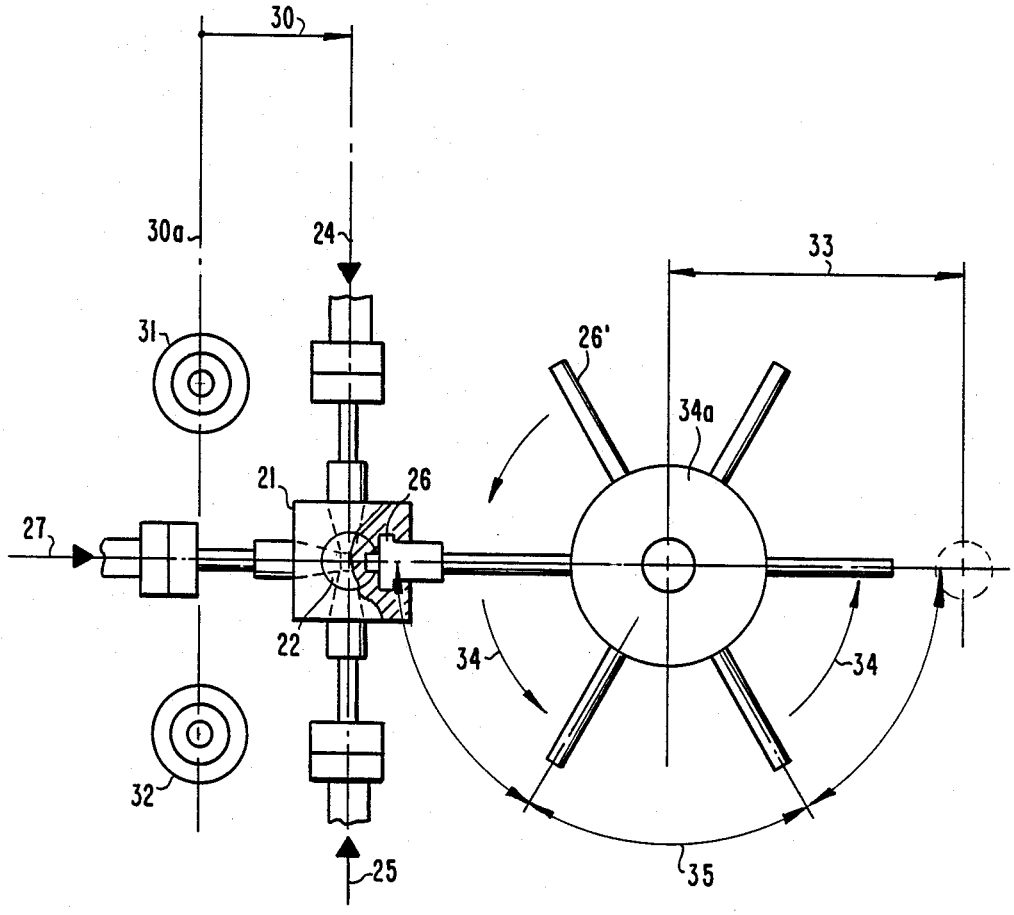
FIG. 2 diagrammatically illustrates the four-core and die arrangement of FIG. 1 in combination with a six-position transfer mechanism.

Referring to FIG. 2 which further depicts the relationship of the excavated cavity 22 (and the cast part) to the two-part die block 21, the top core 24, the rear core 27 and bottom core 25 are attached and driven by the parent machine in an offset position (by distance 30) from the plane **30*a* of the longitudinal axes of the top tie bar guide 31 and the bottom tie bar guide 32. Note that in the disclosed embodiment the mold closing direction, and thus the orientation of the tie bars, is generally horizontal relative to the ground. The transfer core 26 is shown as one of several which are first keyed into the die block 21 as the part is cast upon it and then retracted when the die is opened over the retracted distance 33 and indexed by indexing wheel 34*a* over arc 34 (which is approximately 60 degrees of rotation) around circular path 35. Indexing wheel 34*a* moves distance 33 during retraction from the die and moves back to position inserting adjacent core 26'** into die position.

Figure 3:
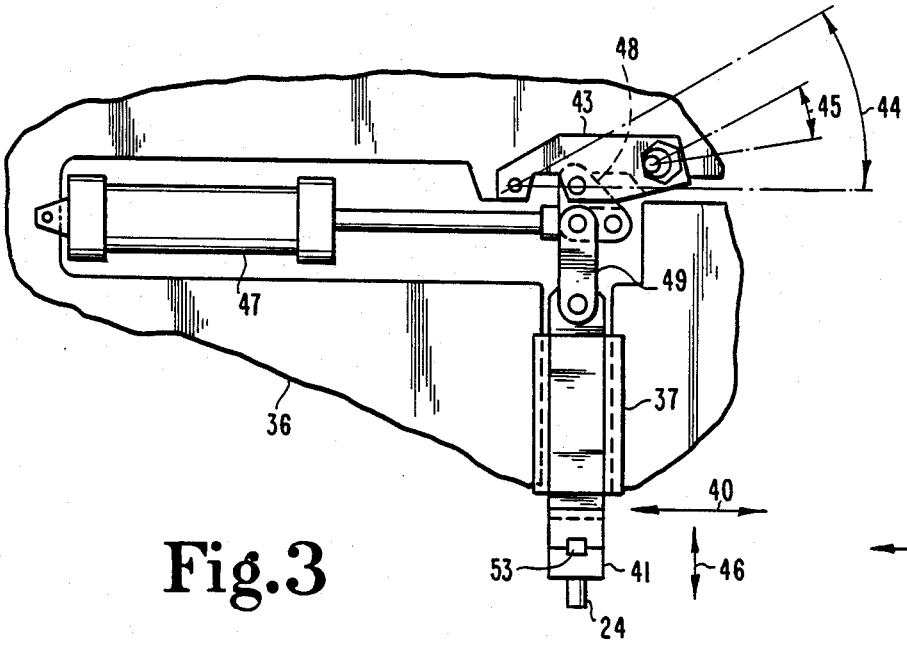
FIG. 3 is a side elevation, diagrammatic illustration of one core-actuator toggle drive and adjustment assembly comprising a portion of the present invention.
Figure 3A:
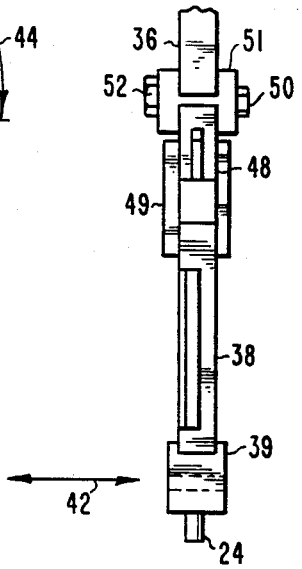
FIG. 3A is a front elevation view, in diagrammatic form, of the FIG. 3 assembly.

Referring to FIGS. 3 and 3A one of the three core drive assemblies used to position cores 24, 25 and 27 is illustrated. FIG. 3 is a side elevation view while FIG. 3A is a corresponding front elevation view. The drive assembly which is illustrated is for core 24 and it is to be understood that virtually identical assemblies exist for cores 25 and 27, though they are positioned 90 degrees apart, as previously described and as illustrated in FIG. 4.

Each core drive assembly is contained within the common surround plate 36 having guidance gibs 37 and slides 38. The slide carries two slide blocks 39 and 41 that provide adjustment in two directions 90 degrees to each other by key 53. Slide block 39 is keyed to slide 38 to give adjustment in the X-direction 40. Block 41 is keyed 90 degrees to slide block 39 and provides adjustment in the Y-direction 42. Z adjustment plate 43 is pivotal along path 44 by the arc distance of the eccentric path 45 providing a range of adjustments in the Z-direction 46. Cylinder 47 serves to drive the toggle member 48 in conjunction with toggle linkage 49 which are given precise adjustment by the eccentric pivot 50 acting within surround plate 36 and yoke 51 and secured by locknut 52.

Figure 4:
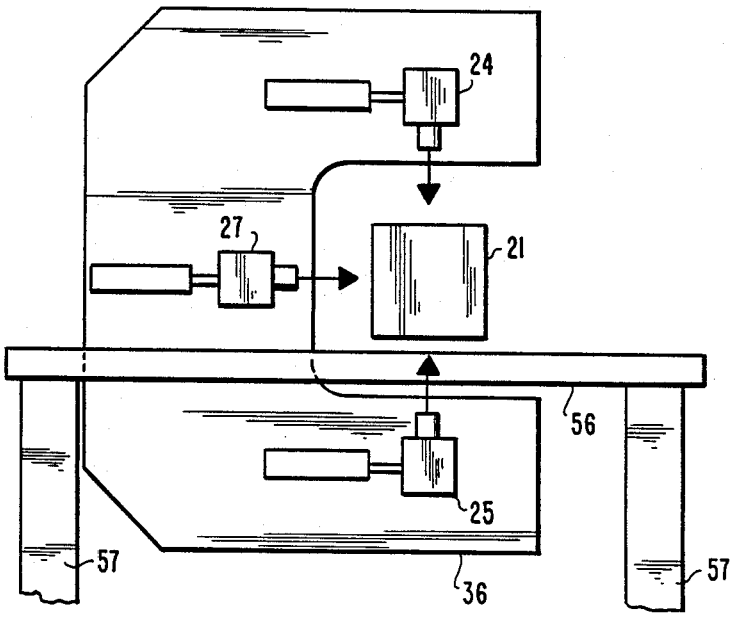
FIG. 4 is a side elevation view in diagrammatic form of the FIG. 1 die illustrated in combination with the machine surround plate.
Figure 5A:
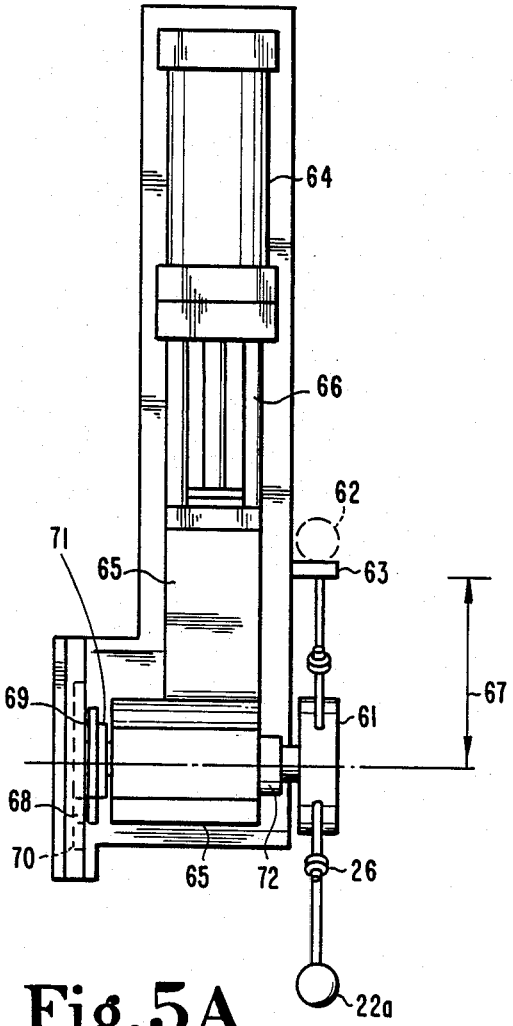
FIGS. 5 and 5A are a side elevation view (turned 90 degrees counterclockwise) and top plan view, respectively, in diagrammatic form, of a rotary part transfer mechanism and cam-actuated indexing drive comprising a portion of the present invention.
Figure 5:
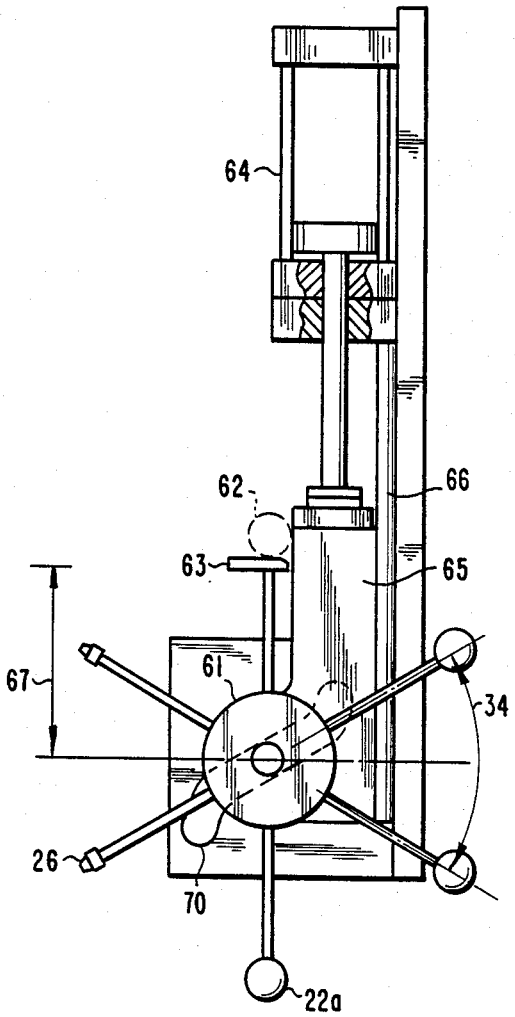

Referring to FIG. 4, the relationship of the machine-mounted cores, 24, 25 and 27 and the surround plate 36, base plate 56 and die block 21, all of which are supported by the three table legs 57, is illustrated. Referring to FIGS. 5 and 5A, the assembly of the part-transfer device is illustrated. The part-transfer device is designed to carry the cast part from the die to a trimming and discharge point. Core 26 is one of several cores mounted on a hub 61 which rotate and index over arc 34. The cast part 22*a* is carried from the die position to the discharge position 62 and is stripped off from the core by stripper 63. Transfer cylinder 64 acts to reciprocate the spindle block 65 along the slideway 66 over the distance 67. A cam follower 68 mounted upon lever 69 and moving within cam tract 70 rotates the wheel hub 61 over one index interval. A one-way clutch 71 allows the cam drive to override in the reverse travel and a friction brake 72 prevents overtravels at the end of stroke.

Figure 6A:
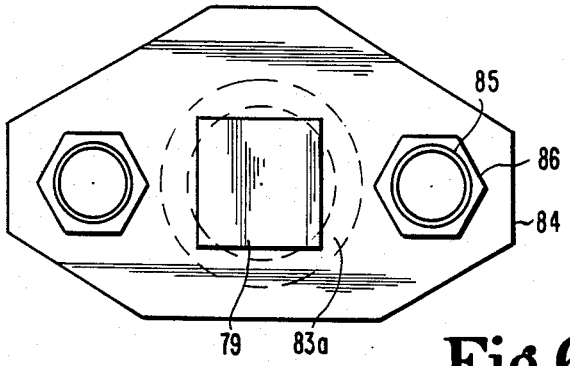
FIGS. 6 and 6A are a front elevation (turned 90 degrees counterclockwise) view and side elevation view, respectively, of a toggle-close and hydraulic die-lock arrangement comprising a portion of the present invention.
Figure 6:
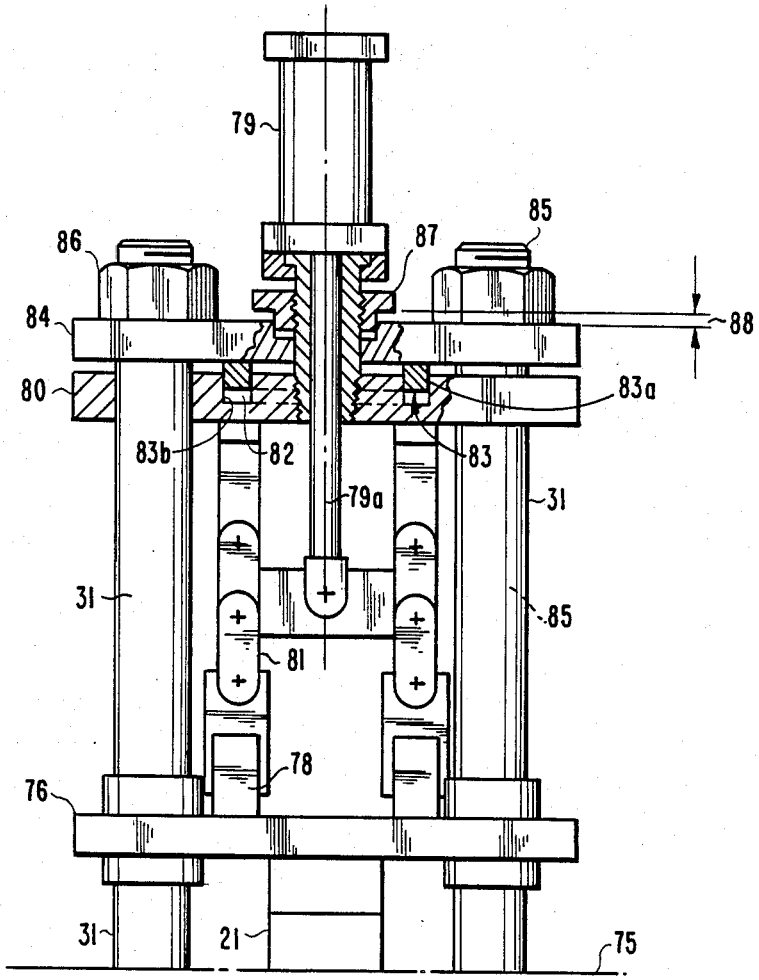

Referring to FIG. 6, this subassembly comprises one-half of the die-close and die-lock mechanism on either side of the parting plane (C/L) 75 of the die block 21. The ejector half of die block 21 is mounted on platen 76 which slides upon and is guided by the tie bar sleeves (guides) 31 (each of which surrounds a corresponding tie bar 85) and supported by lever frames 78. As previously explained, in the preferred embodiment of the present invention, small die-cast parts are produced. The specific mechanism, due to size and shape preferences is arranged such that the die close movement is generally in a horizontal direction relative to the ground. However, since in many applications the movement is normal to the ground, the orientation of FIGS. 6, 6A, 7, 7A, 9, 10, 11, 12, 19 and 20 can be either top plan views or front elevation views. Hydraulic cylinder 79 extends toward and is secured into the toggle support plate 80. Piston 79*a* serves to drive the toggle linkage 81 to close the die faces at plane 75 together and slightly depress the toggle support plate rearward a distance approximately twice the elongation of the tie bar assembly when at full load and in so doing will displace a small volume of fluid from the annular hydraulic cylinder 83 which includes space 82, piston 83*a* and defining side wall 83*b*. This aforedescribed action serves to close the dies together with minimal force because the hydraulic fluid supply in the annular space 82 is open to drain during the interval of die close. Furthermore, cylinder 79 is sized only large enough to close the dies rapidly and reliably but not large enough to generate the required full load die clamp force for casting.

With the toggle linkage 81 collapsed at the start of the closing stroke hydraulic fluid is introduced into annular cylinder 83 so as to hold toggle support plate 80 in position and preclude movement in response to initial toggle extension. Whatever slight initial movement of plate 80 might be possible is limited by the abutment of collar 87 against plate 84. When cylinder 79 is energized piston 79*a* acts on the toggle linkage causing it to unfold and in so doing begins the rapid closing of the die. The toggle linkage gets to virtually full extension and as the last few millimeters are traveled the modest force is sufficient to vent some fluid from cylinder 83. When the restraining force on plate 80 via cylinder 83 is relieved by venting some hydraulic fluid, the toggle linkage goes to full extension and in effect locks and becomes a solid spacer. There is a force balance at modest levels against the die which is now closed and plate 80. However, there has not yet been a suitable die lock force applied to enable die casting.

For the die-lock forces required to safely clamp the dies together to sustain the reaction force of the metal injection action, hydraulic fluid reintroduced into annular space 82 though now at a substantially higher force level than during the initial introduction of fluid. This force which is applied against the annular piston 83*a* also acts against plate 80. The opposite side of piston 83*a* is backed up by bolster plate 84 which is held in a rigid position by the prestressed tie bar and nut 86. The annular nature of cylinder 83 enables enough force to be generated to lock the die closed at a design tonnage. The adjustment collar 87 acts to limit the amount of interference between the die faces as the die faces come together and before the die-close action is completed. Space 88 is a selected amount for the size machine illustrated and is only a fraction of an inch. The end view of the assembly further shows the relative location of the annular die-lock cylinder 83, a form of piston and cylinder that lends itself easily to having enough pressure area to provide the desired press load, and at moderate hydraulic fluid pressures.

Figure 7:
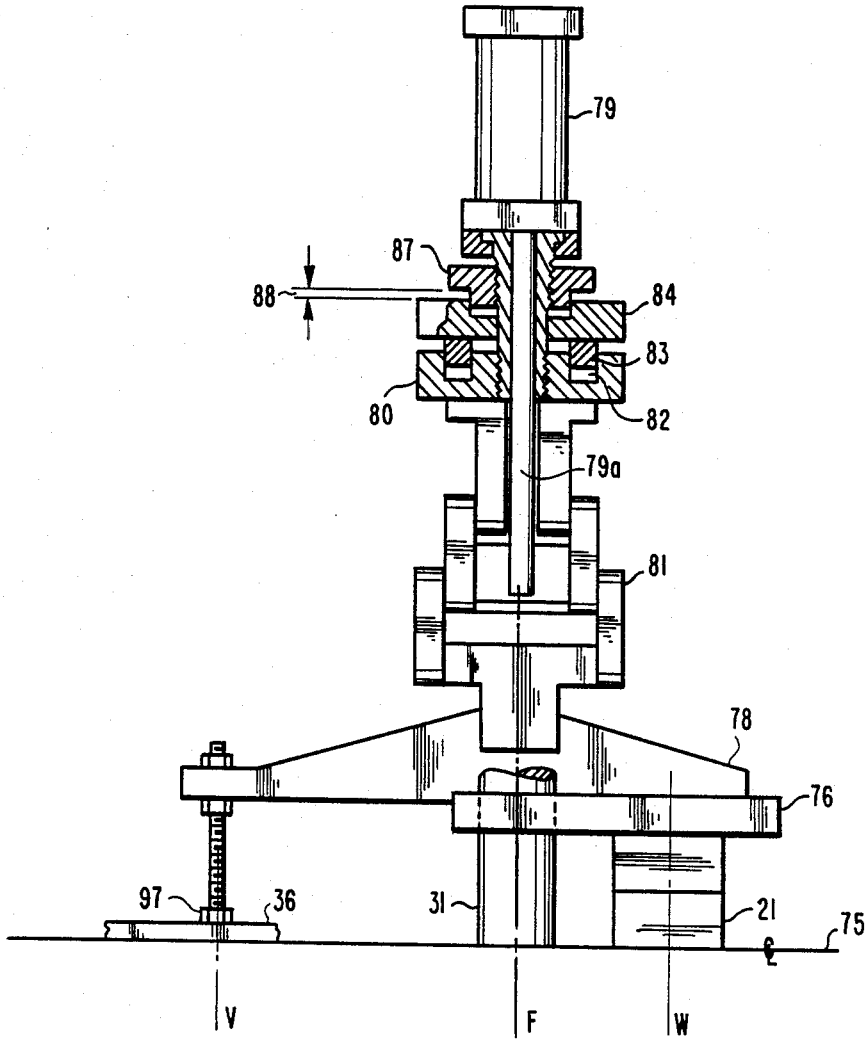
FIG. 7 is a top plan view of the FIG. 6 toggle-close and hydraulic die-lock assembly.

Referring to FIG. 7, there is illustrated a top plan view of the die-close and die-lock assembly shown in FIG. 6. Illustrated in this figure is the relationship of the assembly to the parting plane 75 of the die which is also the center plane of the machine denoted by the "C/L" notation. Herein, the die-closed drive cylinder 79 is shown having an extension which is secured into the toggle support plate 80 and the piston 79*a* extending to drive the toggle linkage 81. This arrangement enables a die-locking force to be applied to the press assembly after the toggles are unfolded from a collapsed condition into a straight line solid spacer and hydraulic fluid at high pressure is introduced into the annular space 82. An adjustment collar 87 provides a limited movement of annular piston 83 by the amount of space 88. In the die-closed and die-locked position shown, the press load is brought to bear upon lever frame 78 along line F, and the lever length reactions occur at lines W at die block 21 and at line V at the adjustable support 97 which bears upon a common stop, surround plate 36. Thus it can be seen that the lever frame 78 carries and backs up the die platen 76 which is slidable along guide sleeve 31. Since there are two lever frames 78 backing up platen 76 on both ends of the die block 21, there are four lever frames and four points of adjustable support 97 that bear the reaction forces of the press load which when adjusted in turn bring a four point reaction to the parting plane (centerline) of the die block 21. The foregoing approach serves to compensate for stress deflection of all the stressed elements and enables balancing of the forces on the die face at a convenient remote location.

Figure 7A:
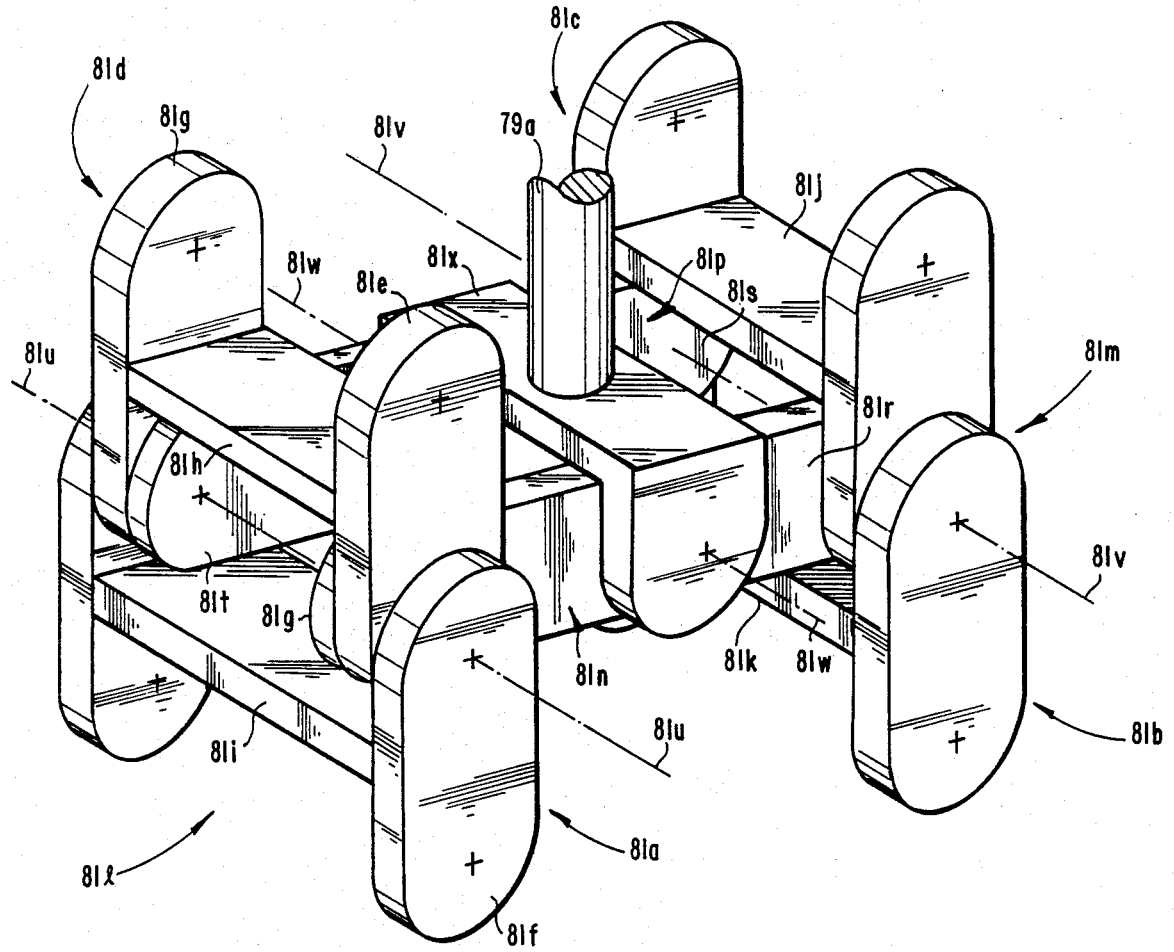
FIG. 7A is a perspective diagrammatic illustration of a suitable toggle linkage assembly for use as part of the FIGS. 6, 6A and 7 toggle-close and hydraulic die-lock assembly.

Referring to FIG. 7A, toggle linkage 81 is illustrated as a perspective view. As should be understood from the FIGS. 6, 6A and FIG. 7 illustrations and from the general nature of the toggle principle, there are a total of four linkage arms 81*a*–81*d* arranged front and rear and side-to-side in a type of four-corners arrangement. Each arm is arranged into a pivotally connected, overlapping pair of links 81*e* and 81*f* (referring to arm 81*a*). It is the lower (inner) end of link 81*e* which is pivotally attached to the upper (inner) end of link 81*f*.

The upper links 81*e* and 81*g* of arms 81*a* and 81*d*, respectively, are rigidly connected by cross brace 81*h*.

As is illustrated, each similarly corresponding pair of links, upper and lower, are connected by corresponding cross braces 81*i*, 81*j* and 81*k*. The result of this arrangement and of the common point of pivotal connection between the upper and lower links in each arm is the creation of a linkage subassembly 81*l* on one side of the cylinder piston 79*a*. A virtually identical linkage subassembly 81*m* is created on the opposite side of piston 79*a*. Connecting these two subassemblies together are two further linkage subassemblies 81*n* and 81*p*. Subassembly 81*n* includes a pair of bars 81*q* and 81*r* which are pivotally attached at one end to each other and at their opposite ends they are respectively pivotally attached to the center pivot point of arms 81*a* and 81*b*. Subassembly 81*p* includes a pair of bars 81*s* and 81*t* which are pivotally attached at one end to each other and at their opposite end they are respectively pivotally attached to the center pivot point of arms 81*c* and 81*d*.

As is intended to be illustrated, pivotal axis line 81*u* is common to the center pivot point of arms 81*a* and 81*d* and to the pivot point of attachment of bars 81*q* and 81*t*. Similarly, pivotal axis line 81*v* is common to the center pivot point of arms 81*b* and 81*c* and to the pivot point of attachment of bars 81*r* and 81*s*. Further, axis line 81*u* is substantially parallel to axis line 81*v* though the location of these lines change as the toggle linkage is collapsed and extended. Pivotal axis line 81*w* is common to the pivotal points of attachment of bar 81*q* to bar 81*r* and of bar 81*s* to bar 81*t*.

Centrally disposed between linkage subassemblies 81*n* and 81*p* is a pivot block 81*x* which is rigidly attached to the lower end of cylinder piston 79*a*. Block 81*x* pivotally connects to the points of pivotal connection between bars 81*q* and 81*r* and between bars 81*s* and 81*t* on axis line 81*w*. Axis line 81*w* is substantially parallel to axis line 81*u* and 81*v*, and remains so throughout the travel of toggle linkage 81.

Figure 8A:
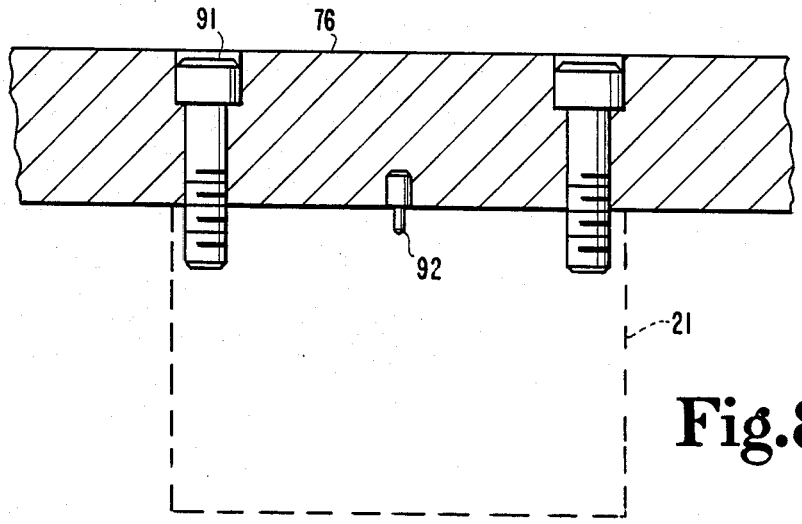
FIGS. 8 and 8A are a top plan view and front elevation view, respectively, of a dual-key positioning configuration, in diagrammatic form, of a machine platen comprising a portion of the present invention.
Figure 8:
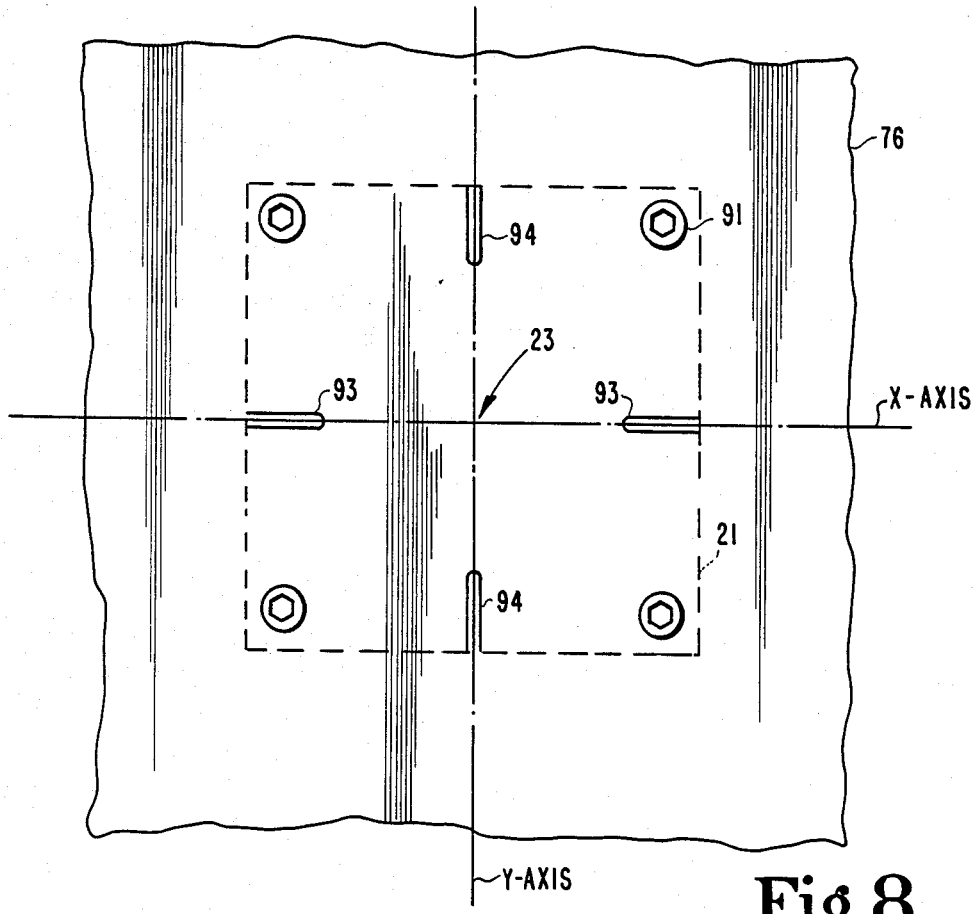
Figure 9:
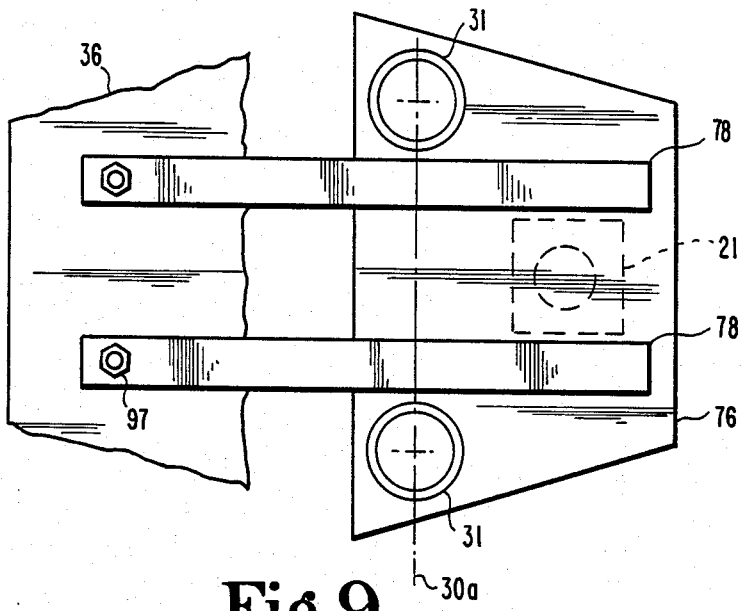
FIG. 9 is a top plan view of a lever frame support assembly comprising a portion of the present invention.
Figure 10:
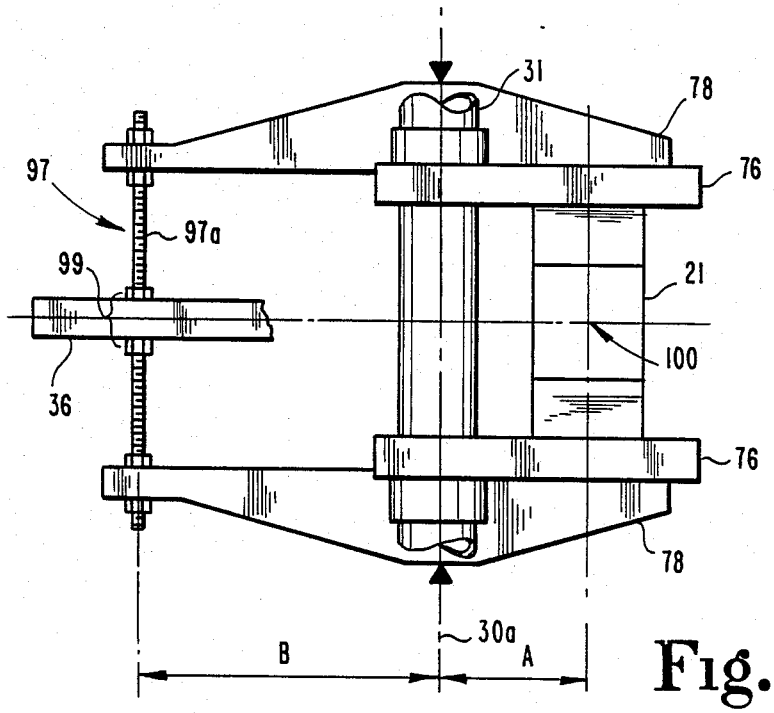
FIG. 10 is a top plan view of the FIG. 9 lever frame support.

Referring to the illustration of FIGS. 8 and 8A, the broken line is the outline of a typical die block 21 which constitutes one die half of the casting (or molding) die. As attached to the machine platen 76 and secured with screws 91. This arrangement is necessary for only one of the die halves because the other die half is brought in reference to the first by integral guide pins. Due to thermal die expansion, the first die is located in reference to the intersection of lines with the die axis and by keys and slots parallel to the centerline axes, X and Y. These axes extend through the die axis 23 ad as illustrated there are die slots 93 on the X-axis and slots 94 on the Y-axis. Keyed pins 92 are disposed in an integral fashion with the machine platen 76.

Injection molding presses of all sizes up to 3,000 tons or more commonly are designed to have either four tie bars or a solid frame on the four corners of the machine. However, presses with the four-corner bar support tend to restrict the installation of dies, the entry of core mechanisms and the accessibility for servicing. It is not uncommon to have to slide one bar out of the way for die installation. While the four-bar arrangement appears to give a fixed and parallel support to the die blocks, nevertheless it still is an elastic assembly that deforms under a load unevenly if the reactive forces within the die are not balanced with the locking forces of the machine and bar assembly.

It has long been the practice to tighten one or more bars to compensate for reactive forces when the die is clamped, thus leaving the machine out of square in respect to the alignment of the actuating mechanisms.

One improvement provided by the present invention is to overcome the die force requirements by the application of a lever frame arrangement using a Class-1 type of lever where the load is applied on one side of the lever, the die reaction on the other side of the lever at one end and an adjustable support at the other end thus enabling independent selection of the areas of load on the die blocks.

In the present invention, two levers are used in parallel to support the platen of the molding (die cast) machine with a die on the opposite side of the platen and in between, a matching platen also having two lever frame supports. The die-clamping force is applied at the focal point of the levers and the reaction force of the die at one end of the levers, while the opposite end of the levers come against an adjustable common support. The ratio of lever length from the focal point to either end can be selected to suit the case, but if both lever lengths are equal and the load applied at the fulcrum, then the load applied to the die lock would equal one-half and the load on the opposite support end would equal one-half as an example. This arrangement as is illustrated more specifically in FIGS. 9, 10, 11 and 12, allows for the die blocks to be extended, offset from the plane of two parallel tie bars that form the press containment. The result is positioning and molding dies out in a space with access from three sides which is favorable to installation, process aids and servicing operations. The four points of adjustable support transmit a reactive force to selectively apply the required balance of force on the die.

With reference to FIGS. 9, 10, 11 and 12, there is illustrated a lever frame linkage wherein the die lock force applied at arrows 98 is applied at the fulcrum point F (see FIG. 11) of a Class-1 type lever which then applies a portion of the force at the axis of die block 21 at a length A and another portion of the force at the adjustable support 97 (see FIGS. 9 and 10) at length B, as a means to extend the die block out away from the plane of the machine clamping force at arrow 98. The value of this particular configuration is in providing clearance for core mechanisms and removal of the part from the die and also to provide a simple means to adjust the application of force to the die locks at a remote location. There are two lever frames on each side of the die parting plane and opposing each other are the four screw adjustments 97*a* which are part of the adjustable support 97 assembly. The screws act in abutment against surround plate 36 and this enables compensation for machine deflection and setup differences in order to apply a force equally over the die faces, or selectively as the process demands it to be applied at line W of the lever frame.

Figure 11:
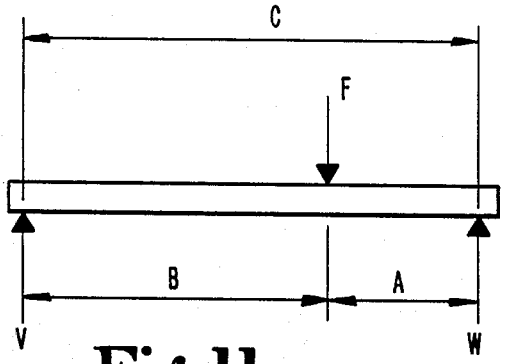
FIG. 11 is a diagrammatic illustration of the class-1 type of lever principle applied with the FIGS. 9 and 10 lever frame support assembly.

In reference to FIG. 11, a Class-1 type of lever is shown having the fulcrum point at F and opposing forces at locations W and V and lengths of A, B and C. In this arrangement, the force F equals the die lock load, the reaction force at W represents the load on the die block and wherein $W=F\times(B/C)$. In reference more particularly to FIG. 12, the die-locking load at arrow 98 applied on the lever frame 78 provides a resultant force on the die block 21 at line W. This figure shows the two pairs of tie bar sleeves 31 upon which the two platens 76 slide to bring the two halves of die block 21 together at the parting plane 75 thus providing a balanced force system. The lower ends of the top pair of tie bar sleeves abut the top surface of surround plate 36.

The upper ends of the lower pair of tie bar sleeves abut the lower surface of surround plate 36.

Figure 12:
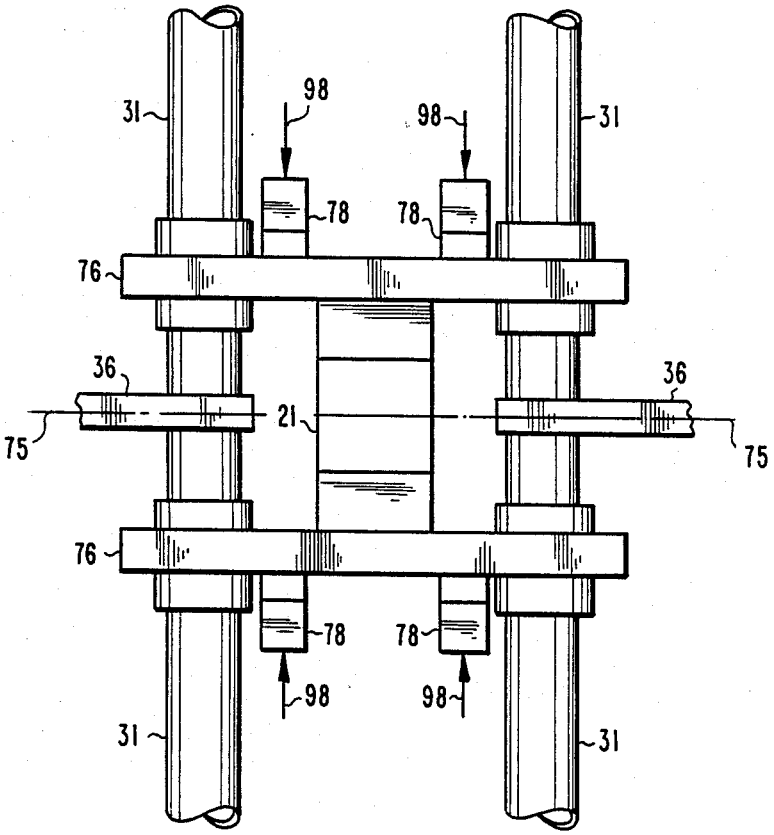
FIG. 12 is a front elevation view (turned 90 degrees counterclockwise) in diagrammatic form revealing the application of the FIG. 11 lever principle to components of the present invention.

The originating force is applied along the plane 30*a* of the two tie bars. The reactive mode on the die block 21 is at W and the reactive load at the common stop is at V. The respective length of the levers on either side of the fulcrum F is shown at A and B. F is the originating line of force on the parting line plane of die block 21. The four adjustable supports 97 on the ends of the four levers serve to selectively apply proportionate loading over the plane of the face of the die block 21. The four ends of lever frames 78 support platens 76 with the die block 21 centered in between. The applied load in the FIG. 12 illustration is on the centerline of the die block. Digressing briefly to FIGS. 7 and 10, these illustrations show the location of the die block 21 on platen 76 as offset from the plane 30*a* of the tie bars 85 and tie bar sleeves 31 by the distance from F to W and the adjustable reaction support 97 at the other end of the lever frames 78.

Figure 13:
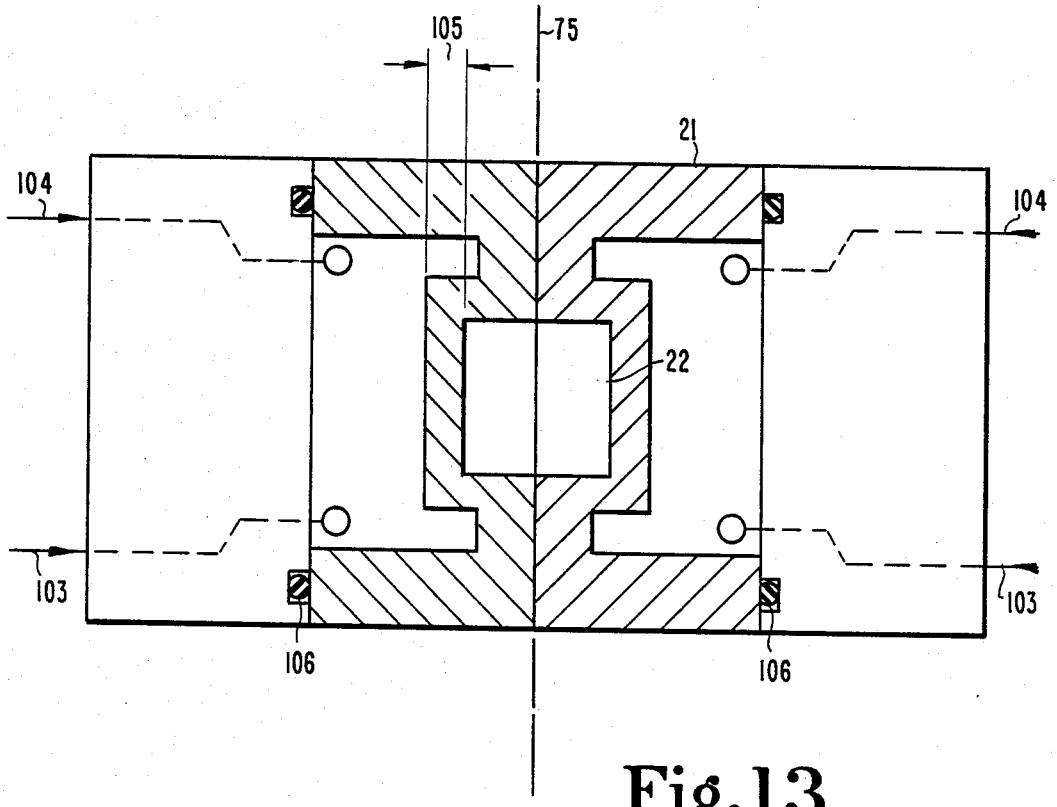
FIG. 13 is a diagrammatic illustration of a water-side excavation relative to the hot metal cavity for heat transfer comprising a portion of the present invention.

In reference to FIG. 13, there is illustrated in cross-sectional view a typical construction to effect improved heat transfer within a molding die and it follows a similar principle to that claimed in U.S. Pat. No. 4,248,289 by Perrella & Thompson. The die block 21 having two die halves on either side of the parting plane 75 (see FIG. 12) contains the part-molding cavity 22 as is common to any two-part mold for the design of the part, but instead of the usual drilled holes for water-cooling passages, the water side is excavated to follow the contour of the part cavity as nearly as practical and leaving a uniform wall thickness 105 through which the heat transfers from the injected hot metal in the cavity to the water side. This technique enables a significant increase in the area of heat transfer on the water side and the designed thickness of the wall as required. For construction convenience, the periphery of the excavated water chamber is sealed off by an O-ring seal 106. Because of the added cooling capacity water is supplied to the die at elevated temperature and pressure to maintain the required minimum die temperature and cooling is effected by boiling, using the heat of evaporation as a constant, thus enabling a closed-circuit system to supply inlet water at the bottom of the die port 103 and exit of the steam at port 104 which is then condensed and returned to the supply circuit.

Figure 14:
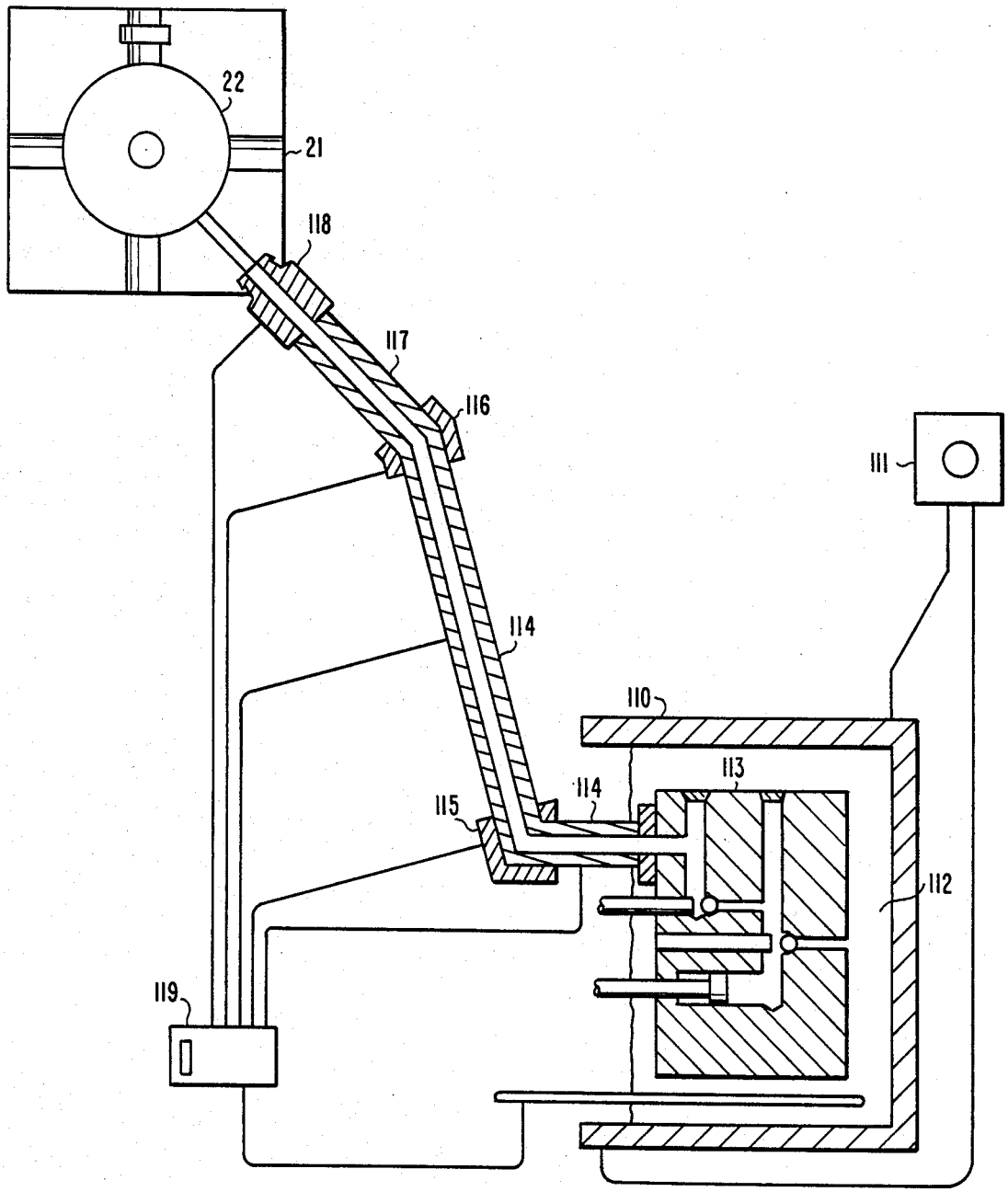
FIG. 14 is a diagrammatic illustration of the hot metal supply means of the present invention.
Figure 15:
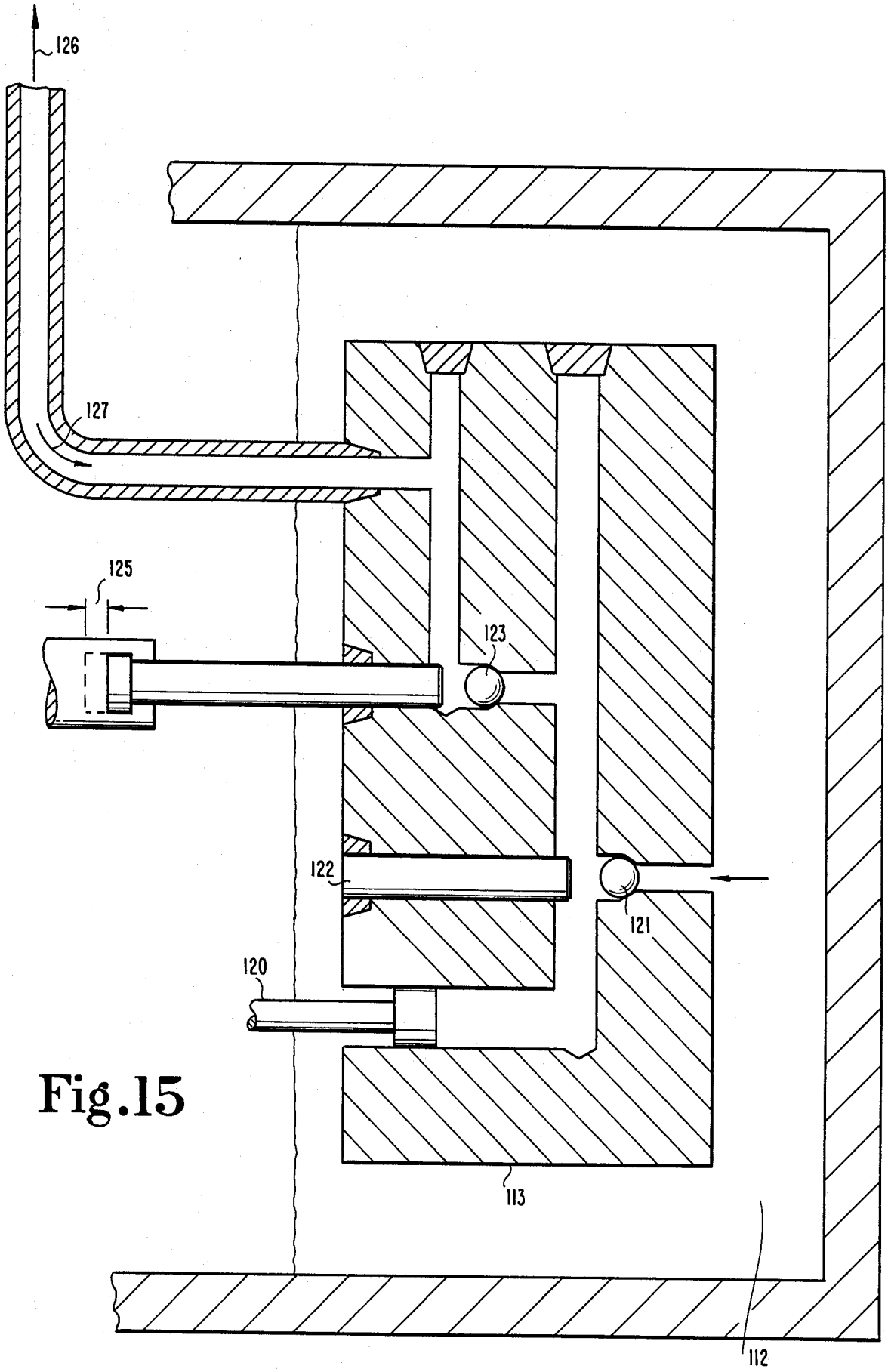
FIG. 15 is an enlarged detail of a portion of the FIG. 14 illustration.

In reference to FIG. 14, there is illustrated an injection system for molten metal 112 which includes holding and supply pot 110 which is heated and controlled by a temperature controller 111 in order to maintain the metal bath within process parameters. Immersed within the bath is the pressure intensifier block 113 and its attendant mechanism. Rising out of the injector is a riser and nozzle extension tubes 114 which is connected by an elbow 115 and coupling 116. The nozzle 117 is attached by coupling 116 and extends to allow the nozzle tip 118 to be positioned within the die block 21 when the dies close around it to direct the fluid metal into the die cavity 22. Both the nozzle 117 and the extension tubes 114 are electrically heated and controlled by power supply 119. In reference to FIG. 15, pressure intensifier block 113 which is immersed in the molten metal supply 112 consists of the intensifier ram 120 which is driven by an external cylinder to provide the process pressure, volume and rate of fill required, an inlet ball valve 121 that allows supply metal to refill the system when ram 120 retracts and the ball is limited during opening by the stop rod 122. Another ball valve 123 allows free flow of fluid metal when ram 120 is depressed and checks back flow when it retracts. A plunger 124 both limits the opening of the ball valve 123 and provides a means to slightly retract the injected metal 126 in the direction of arrow 127 by the amount set by the plunger movement 125, an action which prevents metal drip from the nozzle tip. This action which leaves a minimum of space within the nozzle tip is made possible by valve 123 which prevents the entire amount of fluid within the tubular extensions from draining back to the supply and significantly reduces the amount of air which could be driven into the die cavity.

In reference to FIGS. 16, 16A, 16B, and 16C, nozzle tip 118 is positioned in the die block 21 and clamped between the two die halves at parting plane 75. Tip 118 is stationary relative to the machine and the die halves close together around tip 118. A thermocouple 129 monitors the process temperature and calls for heat as required which is supplied by heat or resistance wire 130 within ceramic beads 131 and wound within double-pitch spiral grooves for efficient radiation absorption and powered with a variable low-voltage current. Thermocouple lead 129*a* is connected to a microvoltmeter. Beads 131 are actually strung on the resistance wire 130 and the double-pitch winding places both ends of the wire together at the thermocouple end of the nozzle 117. The three-sided fins 117*a* disposed in between each wound pitch of the wire and beads provides unique heat transfer properties. The assembly is housed within insulation 128. Precise temperature control of the nozzle body and tip is basic to successful die casting as the flow of fluid metal 126 at high pressure and velocity enters the die cavity 22 via diagonal square inlet 21*a* and channel 21*b*.

Figure 16A:
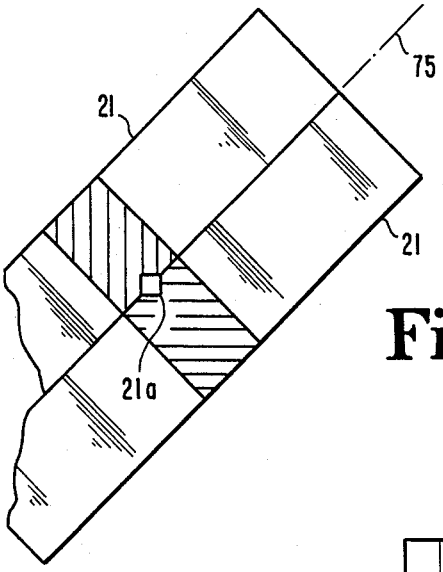
FIG. 16A is a illustration of the inlet configuration for the nozzle as taken along line A—A in FIG. 16.
Figure 16C:
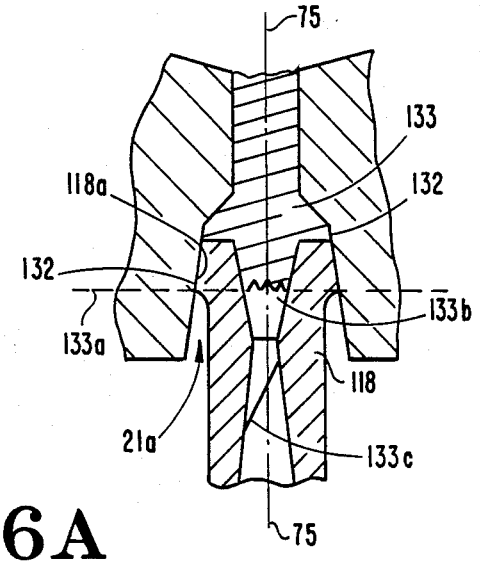
FIG. 16 is a diagrammatic illustration of the nozzle heating and assembly of the nozzle to the die block comprising a portion of the present invention.
FIG. 16B is an enlarged detail of one portion of the FIG. 16 nozzle.
Figure 16:
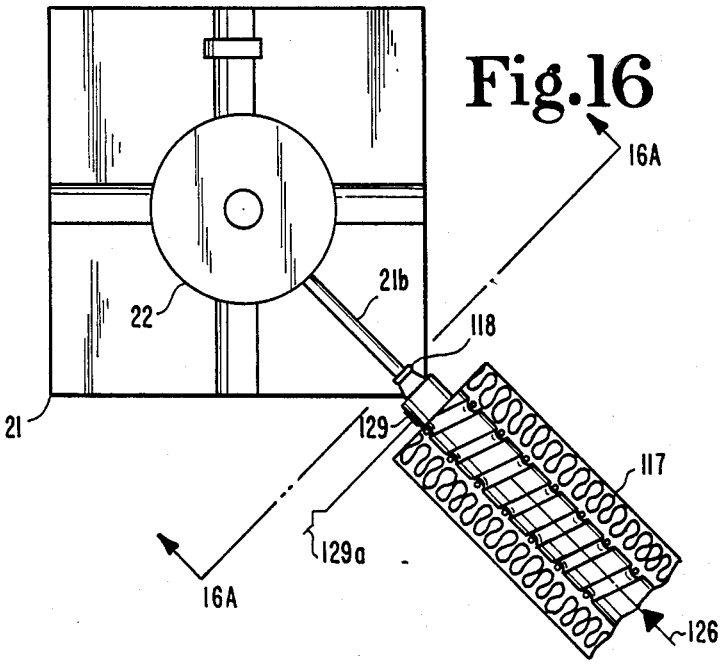
Figure 16B:
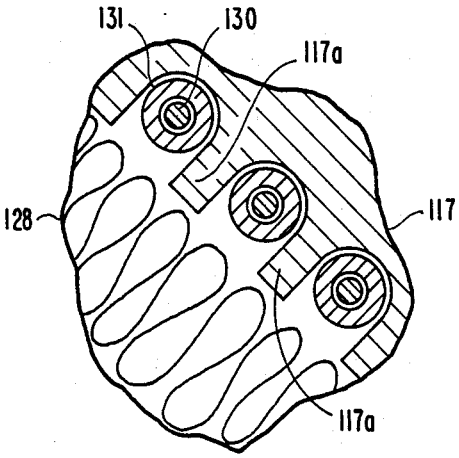

Referring to FIG. 16C, the clamping of nozzle 118 between die halves is illustrated. Nozzle 118 is specially shaped to provide a tight fit along surfacce 118*a* with the tapering side walls 132 of the die block 21. The area of contact is minimized so as to reduce heat transfer as much as possible so as to permit the metal in nozzle 118 to remain molten. The solidified metal of the cast part is shown generally at mass 133. Broken line 133*a* represents the general location of the separation between molten and solid casting metal. Break line 133*b* represents the end of the sprue which is integral with the cast part. Line 133*c* represents the horizontal liquid level of the molten metal, though shown at an angle in FIG. 16*c* due to the angular orientation of the nozzle 118 which is at approximately 20 degrees relative to horizontal.

Figure 17:
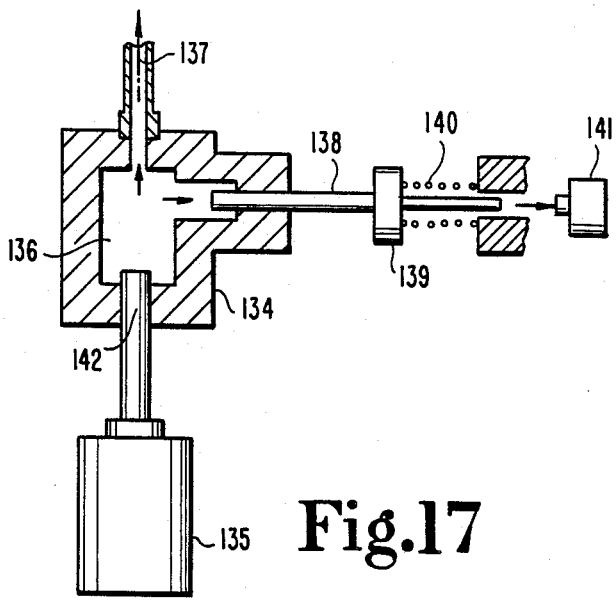
FIG. 17 is a diagrammatic illustration of a hydraulic intensifier comprising a portion of the present invention.

In reference to FIG. 17, there is illustrated as part of a hydraulic die-lock system a pressure-intensifier 134 which acts to supply hydraulic fluid 137 at a selected pressure to effect the die-lock force at arrow 98 on the machine lever frames. An appropriately sized drive cylinder 135 drives the displacement ram 142 into the pressure cavity 136 to supply the required pressure and volume which must reach a preset level. This is sensed by plunger 138 acting against the resistance of an adjustable spring 140, which in turn activates switch 141 to signal for the continuance of the machine cycle, as an assurance that the die-clamp force is adequate. Spring adjust 139 enables the desired spring load to be selectively controlled.

Figure 18:
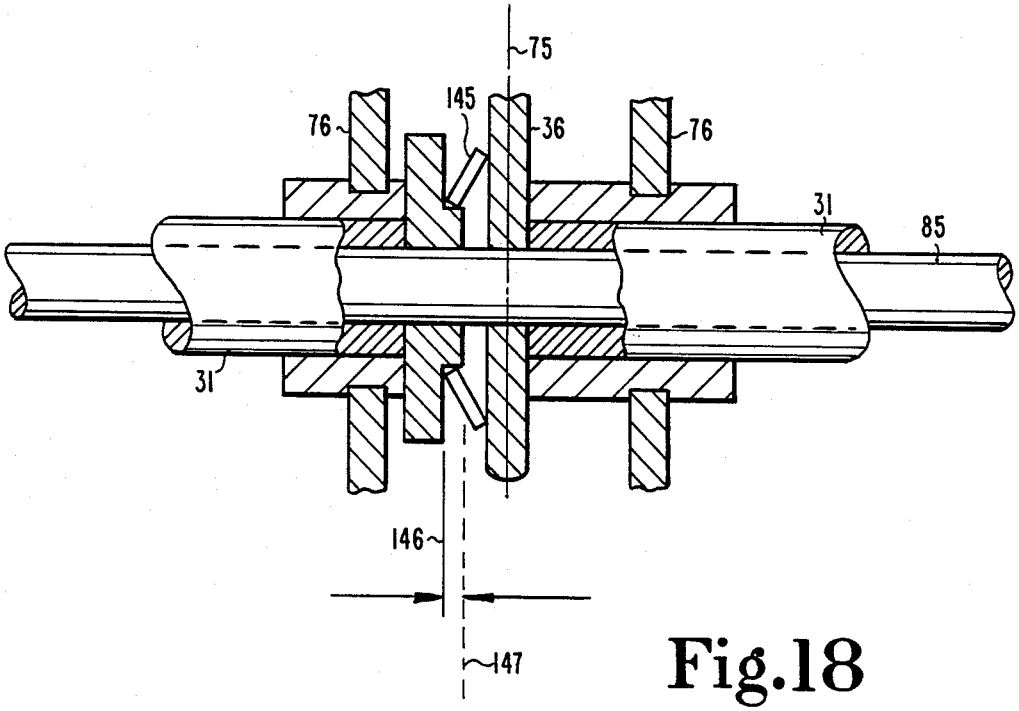
FIG. 18 is a diagrammatic illustration of a die-lock mechanism applied at the parting plane of the die.

In reference to FIG. 18, there is illustrated one of two assemblies located at the parting plane 75 of the machine and on each of the two tie bars 85. The parting plane stop, surround plate 36, is rigidly contained by the compressive forces of top tie bar guides 31 and bottom tie bar guides 32 which are held by the tensile stress of the inner tie bar 85. During the die-closing movement, both right and left-hand platen assemblies 76 simultaneously advance toward the center and one comes into abutment with the face of the surround plate 36 and the other against belleville spring 145 which restrains the movement at position 146. Then, as the hydraulic die-locking force is applied, the spring is overcome and the assembly moves to position 147. This action is necessary to assure that one-half of the die-close movement is dominant enough to bring the die-parting plane to a constant position, since the ultimate die-close force must be to clamp the die shut which necessitates a slight clearance on one of the platen stops.

Figure 19:
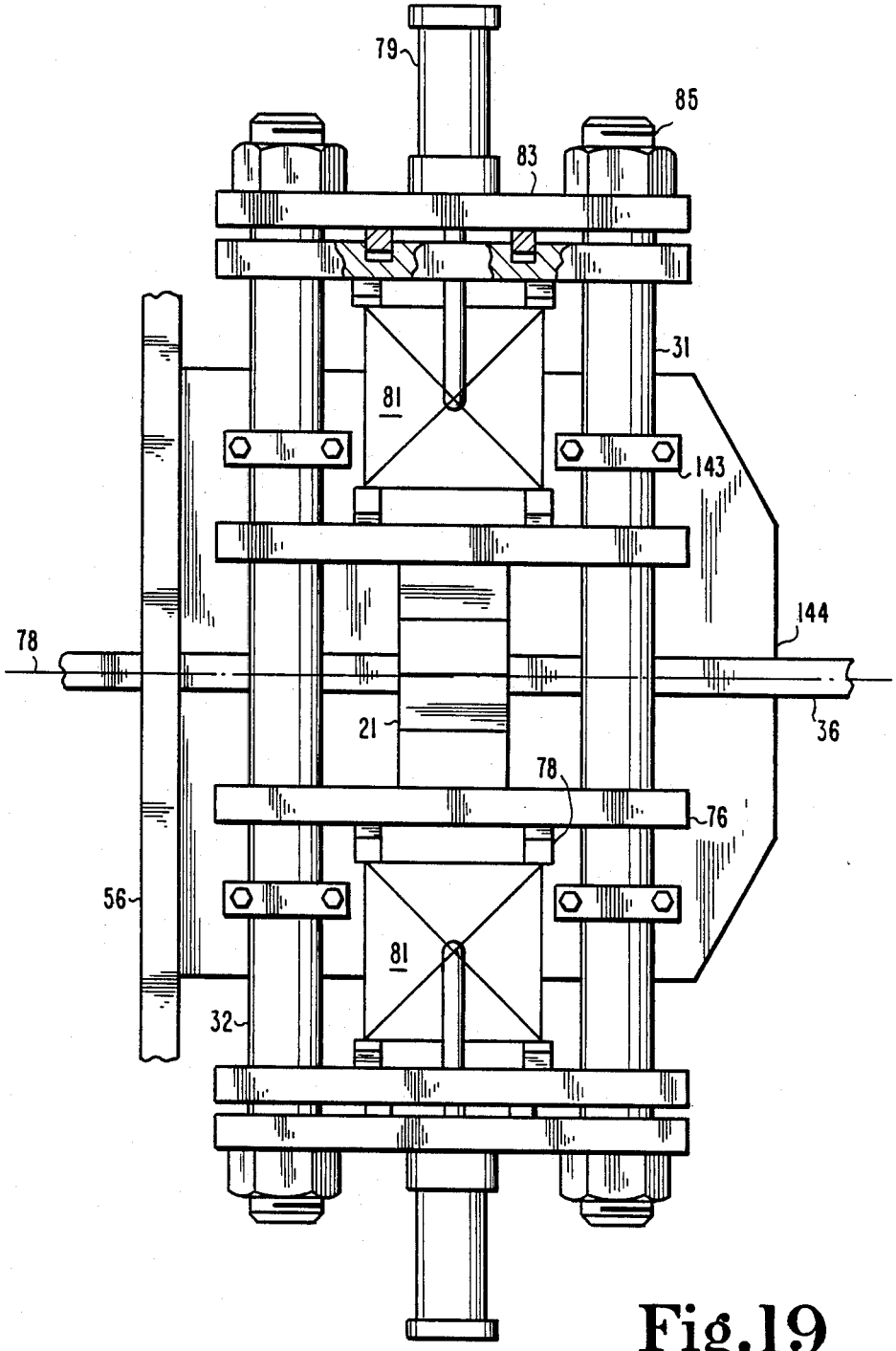
FIG. 19 is a front elevation view (turned 90 degrees counterclockwise) of a dual support for the die-close and die-lock mechanism which may be placed on either side of the machine centerline and surround plate and comprising a portion of the present invention.

Illustrated in FIG. 19 is the position of the die-close assembly in reference to the base plate 56 upon which two knee plates 144 maintain the vertical position of the surround plate 36. Support brackets (clamps) 143 extend out from the knee plates and clamp on the inner tie bars while being contained on both sides by the top tie bar sleeve 31 so as to form a rigid assembly. The overall die-close assembly consists of die block 21 either side of the parting plane 75, the platen 76, the lever frame 78, the toggle linkages 81, the annular hydraulic cylinder 83, the die-closing cylinder 79 and the tie bars 85.

Figure 20:
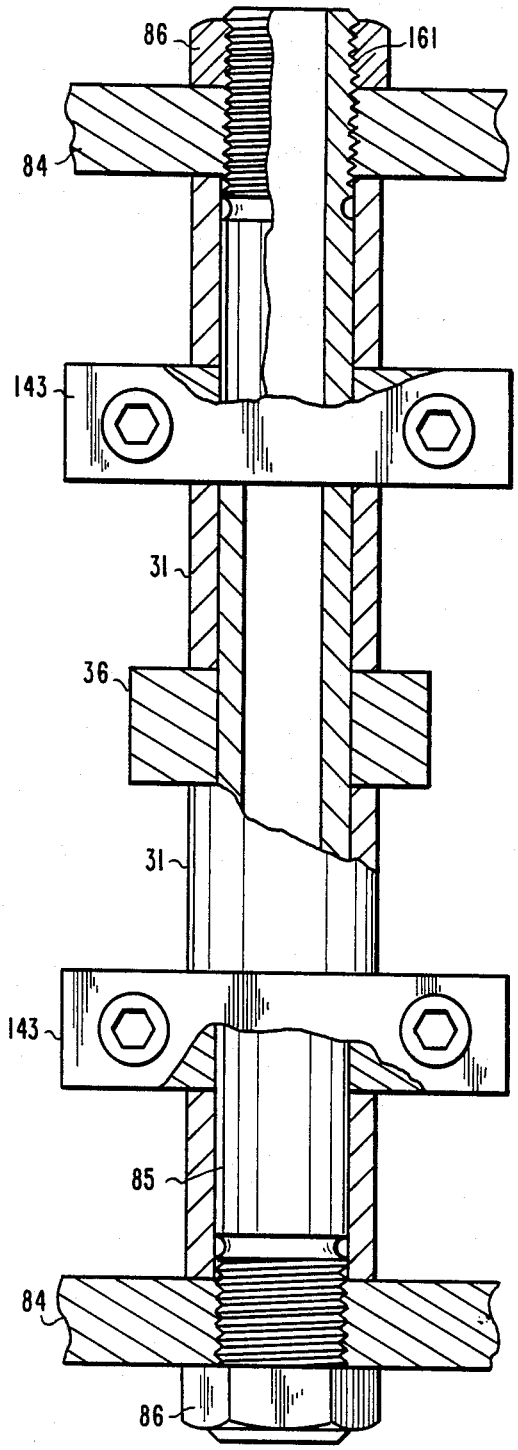
FIG. 20 is a diagrammatic illustration of a compression/tension tie bar assembly.

Referring to FIG. 20, the basis of containment for the main die-close and lock structure is illustrated. This structure provides a means to provide the necessary rigidity of the working members, maintain their position and alignment, establish a central plane of reference, and do so with minimum deflection. The inner element, the tubular tie bar 85, serves as a tension member to prestress the assembly and extends through all of the other components. The tie bar sleeves 31 and 32 are retained in compression and act as spacers between the surround plate 36, the two support clamps 143 and the two end bolster plates 84. At assembly, the two end nuts 86 are tightened to a prescribed amount by measuring the elongation of the inner tie bar 85 and being tubular is a convenient means to gauge the length accurately. In operation, the prestressed bar system effectively doubles the rigidity of the assembly and provides a controllable straightness to the bearing.

Tie bar 85 is configured in a unique fashion as a hollow (tubular) member, externally threaded at each end. The aperture (bore) 160 through the center is generally cylindrical and is of a constant diameter throughout the entirety of the tie bar length. The thread form at threaded ends 161 and 162 are virtually identical to each other and are conventional in size, form and pitch diameter, except that the pitch diameter diminishes slightly, though uniformly, from the outer free end to the inner end adjacent the unthreaded center body portion.

This slight tapering of the pitch diameter has the effect of causing a conventionally threaded nut 86 to come into engagement at the beginning of the thread opposite from the plane of abutment. As the nut 86 shortens under load and the threaded rod (tie rod 85) elongates under load, more and more threads come into play as part of the threaded assembly in order to support the load. The result is a uniformly balanced load over the length of the engagement. This effect is just the reverse of the condition which typically occurs with conventional screw and nut engagement wherein stress builds up over a short length of thread engagement at the plane of abutment to a level above the shear strength of the strongest materials. The result of this is that the notch failure is caused beginning at the first thread which in turn brings about tensile failure of the threaded rod or bolt at the plane of nut abutment.

Figure 21:
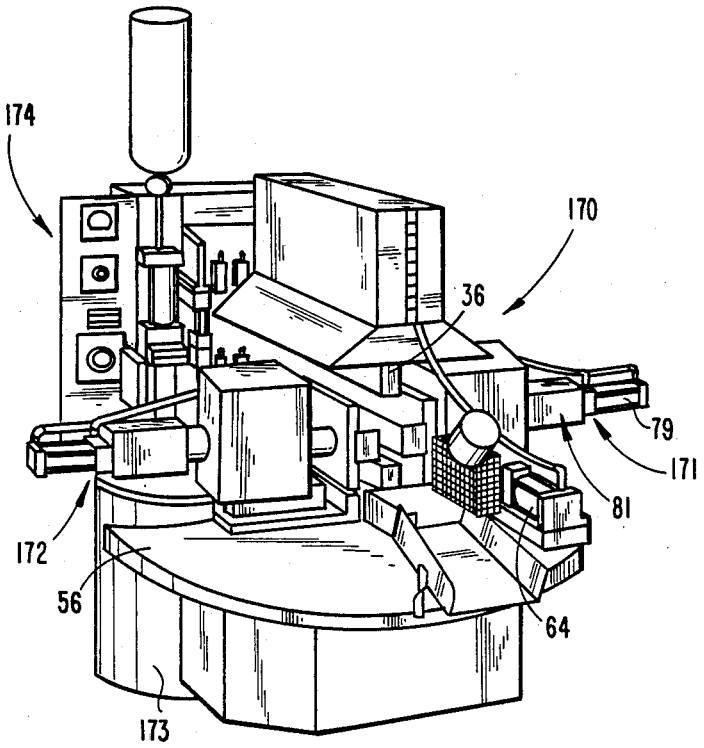
FIG. 21 is a perspective view of the overall general arrangement of the die-casting machine according to the present invention.

Finally, FIG. 21 provides in a single perspective illustration the entire die-casting machine of the present invention, though many of the interior features and relationships previously described cannot be illustrated in this overall view.

Referring to FIG. 21, casting machine 170 includes, in part and for purposes of general orientation, base plate 56, surround plate 36 and cylinder and toggle assemblies 171 and 172. By way of example assembly 171 includes cylinder 79 and double toggle linkage 81. A portion of the FIG. 5 transfer subassembly is illustrated by placement of cylinder 64. Also included is melting pot 173 for the casting metal and a group of controls on panel 174. These controls include a temperature controller for the melting pot, meters to monitor the temperature of the nozzle and nozzle extensions, power stats and transformers.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A die casting machine for the production of a cast part from a two-half die of the type having a parting line and wherein the cast part includes a plurality of cores, said machine comprises:

a frame member including two substantially parallel tie bars disposed in a center plane of the machine and a first movable platen disposed on one side of said parting line and a second movable platen disposed on the opposite side of said parting line, said movable platens being slidably received by said tie bars;

a pair of lever arms wherein a first lever arm supports said first movable platen and a second lever arm support said second movable platen;

a die block arranged into two halves disposed on opposite sides of a die parting line, both halves being positioned remote from said center plane, one half mounted to said first movable platen and the opposite half mounted to said second movable platen;

an arrangement of retractable cores cooperatively arranged with said die block wherein there are a plurality of coaxial pairs, configured for movement along conventional axes; and the positioning of said die block relative to the remainder of said die-casting machine being such that the total of six cores can be machine-introduced.

2. The machine of claim 1 wherein said arrangement of retractable cores includes three coaxial pairs configured along conventonal X, Y and Z axes.

3. The machine of claim 2 wherein one of said retractable cores is designed and arranged to only partially retract prior to die half separation whereby the cast part is impaled on said core for automatic part-stripping.

4. The machine of claim 3 which further includes a rotary indexing wheel having a plurality of stations, each station providing a core structure which is virtually identical to the one of said cores upon which the cast part is impaled.

5. The machine of claim 4 wherein said die block is fixed in position during thermal expansion of the die block by an arrangement of a plurality of slots and keys wherein the slots are located on conventional X and Y axes.

6. The machine of claim 4 wherein the die halves are closed by a force applied co-planar with said center plane.

7. The machine of claim 6 which further includes adjustable force balance means cooperatively arranged with one of said lever arms and disposed on one side of said center plane, said die block disposed on the opposite side of said center plane.

8. The machine of claim 7 which further includes an injection system for molten metal including an extension tube and nozzle, said nozzle having a nozzle tip adapted to fit within said die block.

9. The machine of claim 8 wherein said die block includes an inlet and channel for delivery of molten metal, said inlet and channel having a diamond-square shape for ease in parting of the die block.

10. The machine of claim 1 wherein one of said retractable cores is designed and arranged to only partially retract prior to die half separation whereby the cast part is impaled on said core for automatic part-stripping.

11. The machine of claim 10 which further includes a rotary indexing wheel having a plurality of stations, each station providing a core structure which is virtually identical to the one of said cores upon which the cast part is impaled.

12. The machine of claim 1 wherein the die halves are closed by a force applied co-planar with said center plane.

13. The machine of claim 12 which further includes adjustable force balance means cooperatively arranged with one of said lever arms and disposed on one side of said center plane, said die block disposed on the opposite side of said center plane.

14. The machine of claim 1 which further includes an injection system for molten metal including an extension tube and nozzle, said nozzle having a nozzle tip adapted to fit within said die block.

15. The machine of claim 14 wherein said die block includes an inlet and channel for delivery of molten metal, said inlet and channel having a diamond-square shape for ease in parting of the die block.

16. The machine of claim 15 wherein said injection system further includes a plurality of glass beads strung on resistance wire and wound in a double-pitch spiral as part of said nozzle.

17. The machine of claim 1 wherein said die block is fixed in position during thermal expansion of the die block by an arrangement of a plurality of slots and keys wherein the slots are located on conventional X and Y axes.

* * * * *

UNITED STATES PATENT AND TRADEMARK OFFICE

CERTIFICATE OF CORRECTION

PATENT NO. : 4,832,110

DATED : May 23, 1989

INVENTOR(S) : Guido Perrella, et al

It is certified that error appears in the above-identified patent and that said Letters Patent is hereby corrected as shown below:

Column 2, line 23, change "aove" to --above--.

Column 9, line 48, change "ad" to --and--.

Column 14, line 59, change "conventonal" to --conventional--.

Signed and Sealed this

Thirty-first Day of July, 1990

*Attest:*

HARRY F. MANBECK, JR.

*Attesting Officer*

*Commissioner of Patents and Trademarks*